US009010485B2

(12) United States Patent
Bornemann et al.

(10) Patent No.: US 9,010,485 B2
(45) Date of Patent: Apr. 21, 2015

(54) FLUID LINE HAVING A RESONATOR

(71) Applicant: ContiTech MGW GmbH, Hannoversch-Muenden (DE)

(72) Inventors: Axel Bornemann, Katlenburg-Lindau (DE); Holger Fassl, Calden (DE); Axel Flach, Bad Wildungen (DE)

(73) Assignee: ContiTech MGW GmbH, Hannoversch-Muenden (DE)

( * ) Notice: Subject to any disclaimer, the term of this patent is extended or adjusted under 35 U.S.C. 154(b) by 0 days.

(21) Appl. No.: 13/839,104

(22) Filed: Mar. 15, 2013

(65) Prior Publication Data

US 2013/0213732 A1 Aug. 22, 2013

Related U.S. Application Data

(63) Continuation of application No. PCT/EP2011/063333, filed on Aug. 3, 2011.

(30) Foreign Application Priority Data

Sep. 15, 2010 (DE) ..... 10 2010 037 540

(51) Int. Cl.
*F01N 1/02* (2006.01)
*F02M 35/12* (2006.01)
(Continued)

(52) U.S. Cl.
CPC ..... *G10K 11/002* (2013.01); *F02M 35/10144* (2013.01); *F02M 35/10347* (2013.01); *F02M 35/1216* (2013.01); *F02M 35/1266* (2013.01)

(58) Field of Classification Search
CPC ..... F01N 1/02; F01N 1/023; F01N 1/026; F02M 35/12; F02M 35/1255; F02M 35/1261; F02M 35/1266; F02M 35/1277
USPC ..... 181/212, 229, 249, 250, 269, 272, 243, 181/246
See application file for complete search history.

(56) References Cited

U.S. PATENT DOCUMENTS 3,212,603 A * 10/1965 Walker ..... 181/250
5,723,828 A * 3/1998 Nakagawa ..... 181/250
(Continued)

FOREIGN PATENT DOCUMENTS

DE 10 2008 016 690 A1 10/2009
GB 2 389 150 A 12/2003

OTHER PUBLICATIONS

International Search Report dated Oct. 21, 2011 of international application PCT/EP2011/063333 on which this application is based.

*Primary Examiner* — Edgardo San Martin
(74) *Attorney, Agent, or Firm* — Walter Ottesen P.A.

(57) ABSTRACT

A fluid line includes a resonator having an inner part and a blow-molded outer part defining an inner surface. The inner and outer parts are fixedly connected. The inner part is an injection-molded part having first and second radial collars spaced axially apart from each other. The inner part defines a radial circumference with a plurality of orifices formed therein. The inner and outer parts are axially one within the other so that there is no throughflow of secondary air between the first and second radial collars and the inner surface of the outer part. The inner and outer parts have a common end whereat they are airtightly connected to each other. The inner part, the radial collars and the inner surface of the outer part conjointly define two resonant chambers operatively connected to fluid in the fluid line via the orifices.

6 Claims, 2 Drawing Sheets

(51) Int. Cl.
*G10K 11/00* (2006.01)
*F02M 35/10* (2006.01)

(56) References Cited

U.S. PATENT DOCUMENTS 5,806,480 A 9/1998 Maeda et al.
5,979,598 A * 11/1999 Wolf et al. ..... 181/272
6,684,842 B1 * 2/2004 Hellie et al. ..... 123/184.57
6,715,580 B1 * 4/2004 Gerstner et al. ..... 181/224
6,752,240 B1 6/2004 Schlagenhaft
6,983,820 B2 * 1/2006 Boast et al. ..... 181/249
7,584,821 B2 * 9/2009 Prior et al. ..... 181/241
7,779,822 B2 * 8/2010 Prior et al. ..... 123/559.1
7,810,609 B2 * 10/2010 Sikes et al. ..... 181/250
7,934,581 B2 * 5/2011 Kim et al. ..... 181/250
8,327,975 B2 * 12/2012 Ortman et al. ..... 181/264
8,408,357 B2 * 4/2013 Cheung ..... 181/224
2003/0085071 A1 * 5/2003 Boast et al. ..... 181/249
2005/0150718 A1 7/2005 Knight et al.
2007/0295554 A1 * 12/2007 Flucht et al. ..... 181/213
2010/0193282 A1 8/2010 Kim et al.
2011/0299981 A1 * 12/2011 Li ..... 415/206

* cited by examiner

FLUID LINE HAVING A RESONATOR

CROSS REFERENCE TO RELATED APPLICATIONS

This application is a continuation application of international patent application PCT/EP2011/063333, filed Aug. 3, 2011, designating the United States and claiming priority from German application 10 2010 037 540.3, filed Sep. 15, 2010, and the entire content of both applications is incorporated herein by reference.

FIELD OF THE INVENTION

The invention relates to a fluid line having at least one resonator, in particular an air line, the resonator having an inner part and an outer part, and the inner part and outer part being connected to one another firmly and unreleasably.

BACKGROUND OF THE INVENTION

Resonators in fluid lines have been known and in use for a long time for the purpose of avoiding unpleasant acoustic emissions during oscillations of the fluid in the fluid line. They are nowadays made mostly from plastics, above all injection-molded parts, but also blow-molded parts, being employed. Injection-molded parts have the disadvantage that their production is mostly very complex and costly. By contrast, blow-molding is a relatively cost-effective production method, and therefore the objective is increasingly to use blow-molded parts.

DE 10 2008 016 690 A1 shows a generic resonator in which both resonator parts are formed as blow-molded parts. The parts have, in each case, a collar and are connected to one another in an airtight manner at these collars.

The technical teaching disclosed in DE 10 2008 016 690 A1 makes it possible to have only resonators with only one resonant chamber. This single chamber is connected to the actual fluid line by means of an annular gap 19 shown in FIGS. 5 and 6. Although this solution is distinguished by its great simplicity, the possibilities for using it are nevertheless restricted, since multichamber systems cannot be implemented without further outlay.

U.S. Pat. No. 5,806,480 discloses a fluid line which has, in a longitudinal section, two pipes which are arranged one in the other and between which is arranged a chamber encasing the inner pipe. In this case, this chamber communicates with the interior of the inner pipe via orifices which are incorporated into the inner pipe. To produce this pipe piece, the inner pipe is first injection-molded. A blank for the outer pipe is then produced via an extrusion method such that the blank encases the inner pipe. The outer pipe blank is subsequently formed by means of a blow-molding method in order to produce the outer pipe.

To carry out the extrusion and blow-molding operations, a complicated die is required here, since the entire line piece has to be capable of being introduced into the die (see FIG. 3 of U.S. Pat. No. 5,806,480) and a specific die has to be provided correspondingly for each line piece.

SUMMARY OF THE INVENTION

It is an object of the invention to provide a fluid line having a resonator of the type described above which can be made in a simple manner.

This object is achieved in that the inner part of the resonator is formed as an injection-molded part which has at least two radial collars which are spaced axially apart from one another. The inner part has, distributed on its radial circumference, orifices. The outer part is formed as a blow-molded part and the inner part and outer part are plugged axially one into the other in such a way that secondary air cannot flow through between the radial collars of the inner part and the inner surface of the outer part. The inner part and the outer part are connected to one another, airtight, at a common communicating axial end. At least two resonant chambers are formed by the inner part, the radial collars of the inner part and the inner surface of the outer part and the resonant chambers are operatively connected to the fluid in the fluid line via the orifices in the radial circumference of the inner part.

This solution according to the invention makes it possible to employ cost-effective blow-molded parts for the outer part. A plurality of resonant chambers are available for shifting the resonance of the fluid system, even different chamber sizes being possible by a variation in the axial spacing of the collars of the inner part. The blowing device for producing the outer part is independent of the rest of the shape of the fluid line for all the resonators of a particular type. Since an annular gap is not provided, the flow resistance of the resonator according to the invention is correspondingly optimized.

In an embodiment of the invention, at least one further part of the fluid line is formed as a blow-molded part, the outer part of the resonator being formed as a portion of the further blow-molded part of the fluid line and being in one piece therewith, and being arranged at at least one of the ends of the fluid line part.

By virtue of this embodiment, the outer part of the resonator is an integral constituent of the fluid line. There is no need for a clamping or other connection to this part of the fluid line. Accordingly, on the one hand, the mounting of the resonator is simplified and, on the other hand, the risk of leaks due to mounting errors at this location is also eliminated.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
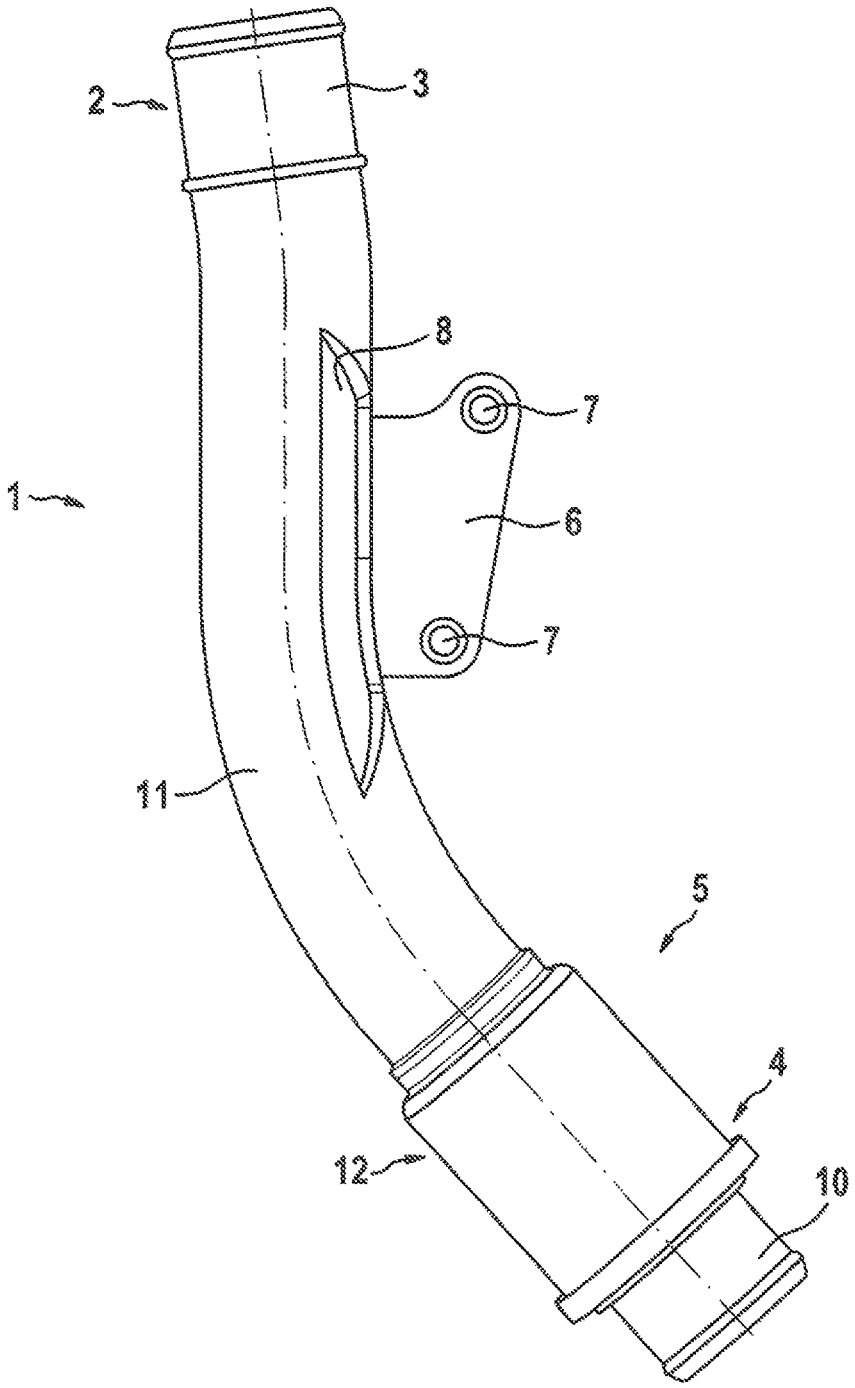
FIG. 1 is a top view of a fluid line according to the invention.

FIG. 1 shows a fluid line 1 according to the invention. The fluid line 1 has at a first end 2 a connection piece 3 for connecting a further fluid-conducting component, not shown here. A resonator 5 is arranged at a second end 4. Moreover, the fluid line 1 has a holder 6 with fastening bores 7 which is welded to a stiffening strut 8 and to the fluid line 1.

The resonator 5 has a connection piece 10 which likewise serves for connection to further fluid lines, not shown. The fluid line 1 has an outer pipe 11 which is formed as a blow-molded part from a thermoplastic. At its end 4 assigned to the resonator 5, the outer pipe 11 is expanded in a region 12 radially with respect to the rest of the outer pipe 11.

Figure 2:
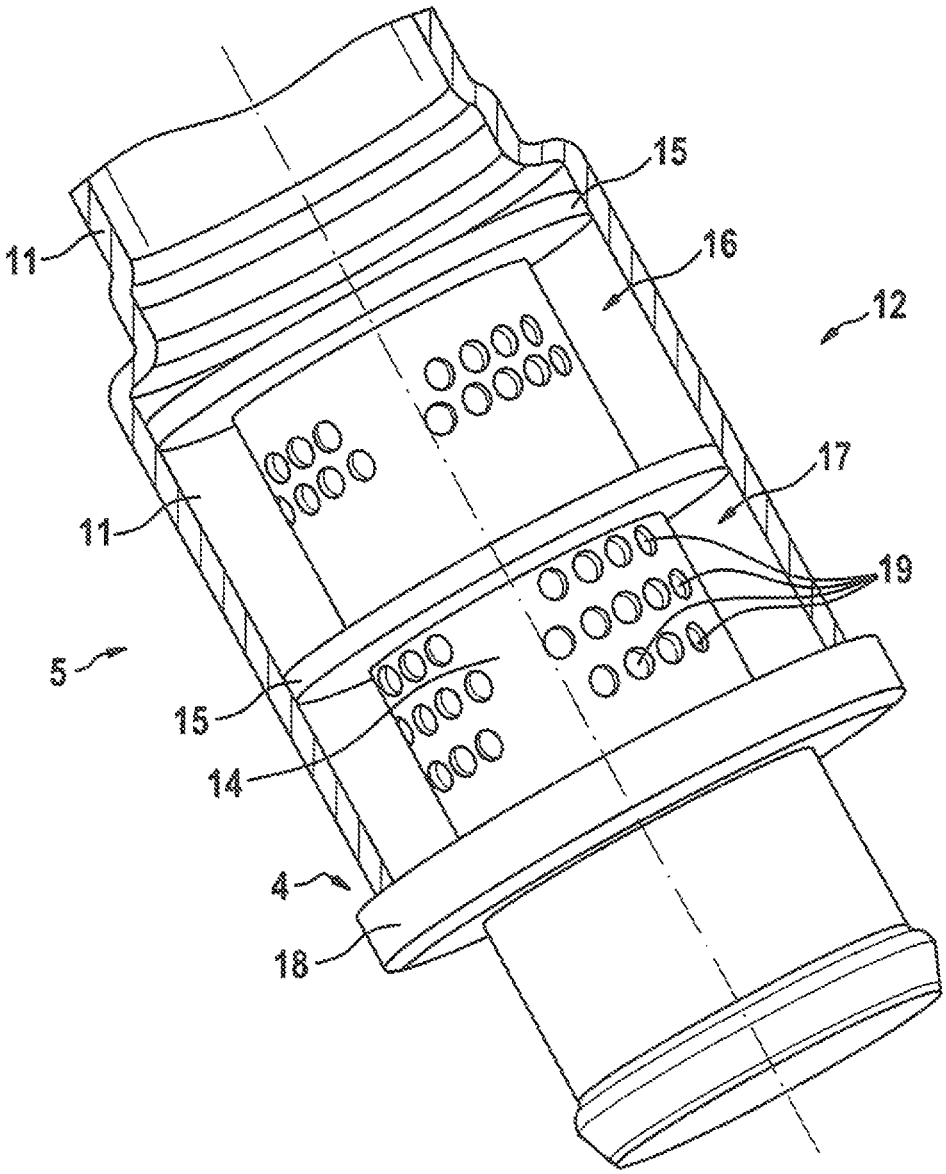
FIG. 2 is a detailed view of the resonator.

FIG. 2 shows the resonator 5 in such a manner that the outer pipe 11 is illustrated as being cut away. The resonator 5 has, in addition to the outer pipe 11 expanded in the region 12, an inner part 14 which is formed as an injection-molded part likewise from plastic. The inner part 14 has collars 15 which point radially outward and which are fitted into the expanded part 12 of the outer pipe 11 in such a manner that no gap occurs between the collars 15 and the outer pipe (11, 12).

As shown in FIG. 2, the expanded part 12 of the outer pipe has an uninterrupted smooth inner wall surface. The collars 15 have respective peripheral surfaces which are directly in contact engagement with the inner wall surface of outer pipe (11, 12).

The arrangement of the inner part 14, collars 15 and outer pipe (11, 12) delimits resonant chambers 16 and 17. The resonant chamber 17 is delimited not only by a collar 15, but also by a close-off collar 18. The close-off collar 18 has a diameter which is greater than the diameter of the expanded part 12 of the outer pipe 11 and is welded in an airtight manner to the end 4 of the outer pipe (11, 12).

The inner part 14 has a multiplicity of orifices 19, through which it is possible for a fluid, not shown here, flowing through the resonator 5 to communicate with the resonant chambers 16 and 17.

As a result of the communication of the fluid with the resonant chambers 16 and 17 via the orifices 19, the oscillation frequency of the fluid can be shifted, so that undesirable acoustic effects can be reduced. The resonator 5 can be adapted to the most diverse possible oscillation conditions by, predetermined in each case, the number and/or the axial spacing of the collars 15. Further fluid-conducting components, not shown, can be connected to the connection piece 10 of the resonator 5.

It is understood that the foregoing description is that of the preferred embodiments of the invention and that various changes and modifications may be made thereto without departing from the spirit and scope of the invention as defined in the appended claims.

LIST OF REFERENCE SYMBOLS

Part of the Description

1 Fluid line
2 First end of the fluid line 1
3 Connection piece
4 Second end of the fluid line 1
5 Resonator
6 Holder
7 Fastening bores
8 Stiffening strut
10 Connection piece
11 Outer pipe
12 Expanded region of the outer pipe 11
14 Inner part of the resonator 5
15 Radial collars of the inner part 14
16, 17 Resonant chambers
18 Close-off collar
19 Orifices in the inner part 14

What is claimed is:

1. A fluid line comprising:

an annular conduit for conducting a fluid therethrough;

said annular conduit defining a longitudinal axis and including a first longitudinal segment having a first diameter and a second longitudinal segment having a second diameter greater than said first diameter;

said annular conduit being a single integral blow-molded part;

at least one resonator extending over said second segment and having an inner part and an outer part having an uninterrupted smooth inner surface;

said outer part being defined by said annular conduit at said second segment thereof;

said inner part and said outer part being fixedly and non-detachably connected to each other;

said inner part of said resonator being a single integral injection-molded part having at least a first radial collar, a second radial collar and a close-off collar spaced axially apart from each other;

said close-off collar having a diameter which is greater than a diameter of said second segment;

said inner part defining a radial circumference and having a plurality of orifices therein distributed over said radial circumference;

said inner part being axially plugged into said outer part over an insertion length within said second segment and in such a manner that there is no throughflow of secondary air between said first and said second radial collars and said inner surface of said outer part with said first and second collars having respective peripheral surfaces in contact engagement with said uninterrupted smooth inner surface of said outer part;

said inner part and said outer part having a common, communicating end whereat said inner part and said outer part are fluid-tightly connected to each other;

said inner part, said radial collars, said close-off collar and said inner surface of said outer part conjointly defining at least two resonance chambers;

said resonance chambers being configured to be operatively connected to fluid in the fluid line via said orifices of said inner part;

said inner surface of said outer part having a constant radius over said insertion length;

said first longitudinal segment and said second longitudinal segment conjointly defining a stepped interface whereat said annular conduit transitions from said first diameter to said second diameter along a portion of said longitudinal axis;

said first radial collar having a surface facing toward said first longitudinal segment; and, said stepped interface and said surface of said first radial collar conjointly defining an annular fluid-accessible gap therebetween.

2. The fluid line of claim 1, wherein said resonator is an air line.

3. The fluid line of claim 1, wherein said first collar, said second collar and said close-off collar are spaced axially apart from each other so as to form said resonance chambers having respectively different sizes to shift the resonance of the fluid system.

4. The fluid line of claim 1, wherein said fluid line consists only of said annular conduit and said inner part.

5. The fluid line of claim 1, wherein said resonator includes a conduit connecting piece extending therefrom for connecting said fluid line to an additional fluid-conducting component.

6. The fluid line of claim 1, wherein said first segment of said annular conduit has an outer surface; and, wherein said fluid line further comprises: a stiffening strut on said outer surface; and, a holder welded to said stiffening strut.

* * * * *